US011372364B2

(12) United States Patent
Matsumura

(10) Patent No.: US 11,372,364 B2
(45) Date of Patent: Jun. 28, 2022

(54) FRAME OF IMAGE FORMING APPARATUS AND IMAGE FORMING APPARATUS

(71) Applicant: CANON KABUSHIKI KAISHA, Tokyo (JP)

(72) Inventor: Takuya Matsumura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/231,739

(22) Filed: Apr. 15, 2021

(65) Prior Publication Data

US 2021/0356903 A1 Nov. 18, 2021

(30) Foreign Application Priority Data

May 15, 2020 (JP) ..... JP2020-086346

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
See application file for complete search history.

(56) References Cited

U.S. PATENT DOCUMENTS 6,580,886 B1 * 6/2003 Howard ..... G03G 21/1619 399/110
9,535,365 B2 1/2017 Ishikawa et al. ..... F16H 1/08
10,025,270 B2 7/2018 Takahashi et al. .. G03G 21/206
10,082,767 B2 9/2018 Matsumura ..... G03G 21/1619
10,162,306 B2 12/2018 Takahashi et al. .. G03G 21/206
10,216,136 B2 2/2019 Suzuki et al. ..... G03G 15/70
10,372,078 B2 8/2019 Narita et al. ..... G03G 21/1647
2010/0014887 A1 * 1/2010 Tomatsu ..... G03G 21/1619 399/107
2011/0129250 A1 * 6/2011 Kondo ..... G03G 21/1619 399/107

(Continued)

FOREIGN PATENT DOCUMENTS

JP 2000-077858 3/2000

OTHER PUBLICATIONS

U.S. Appl. No. 17/230,812, filed Apr. 14, 2021.

(Continued)

*Primary Examiner* — Sandra Brase
(74) *Attorney, Agent, or Firm* — Venable LLP

(57) ABSTRACT

A frame for an image forming apparatus which includes a sheet cassette, an image forming unit, a first conveying roller, and a second conveying roller. The frame includes a first frame above which a second frame is coupled, the first frame supporting the sheet cassette and the first conveying roller, and the second frame supporting the second conveying roller and the image forming unit. A coupling member couples a first strut and a second strut, the first strut being part of the first frame and including: a first base portion; a first plate portion; and a second plate portion. The second strut is part of the second frame and includes: a second base portion disposed above the first base portion and contacting the first base portion; a third plate portion; and a fourth plate portion. The coupling member includes: a third base portion opposed to and spaced apart from the first base portion and the second base portion; a fifth plate portion; and a sixth plate portion.

13 Claims, 12 Drawing Sheets

(56) References Cited

U.S. PATENT DOCUMENTS

| | | | | |
|---|---|---|---|---|
| 2013/0195503 | A1 | 8/2013 | Nakagaki | 399/107 |
| 2014/0001696 | A1 | 1/2014 | Yoshida | 271/9.01 |
| 2016/0195844 | A1 | 7/2016 | Takei | 312/223.1 |
| 2019/0049889 | A1 | 2/2019 | Ishikawa | G03G 15/556 |

OTHER PUBLICATIONS

U.S. Appl. No. 17/230,836, filed Apr. 14, 2021.
Extended European Search Report dated Sep. 24, 2021 in counterpart EP Application No. 21169820-4.

* cited by examiner

FRAME OF IMAGE FORMING APPARATUS AND IMAGE FORMING APPARATUS

BACKGROUND OF THE INVENTION

Field of the Invention

The present invention relates to an image forming apparatus, such as an electrophotographic copying machine or an electrophotographic printer (e.g., a laser-beam printer or an LED printer) and a frame which supports each unit of the image forming apparatus.

Description of the Related Art

Conventionally, known has been a configuration in which a first frame and a second frame disposed above the first frame in the vertical direction are coupled together as a frame of an image forming apparatus, similarly to a configuration in Japanese Patent Application Laid-Open No. 2000-77858. The first frame supports a sheet cassette which houses sheets and a first conveying roller which conveys a sheet extracted from the sheet cassette. The second frame supports a second conveying roller which receives a sheet from the first conveying roller and conveys the sheet and an image forming unit which forms an image on the sheet conveyed by the second conveying roller.

In the image forming apparatus, the sheet cassette and the first conveying roller described above are positioned to the first frame, and the image forming unit and the second conveying roller are positioned to the second frame. The first frame and the second frame each include a plurality of struts extending in the vertical direction and a plurality of stays coupling the plurality of struts together. The sheet cassette and the first conveying roller described above are positioned and secured directly or indirectly to the plurality of struts of the first frame. The image forming unit and the second conveying roller described above are positioned and secured directly or indirectly to the plurality of struts of the second frame. Therefore, a lower positional accuracy between the struts of the first frame and the struts of the second frame causes a large deviation in the relative position between the first conveying roller and the second conveying roller.

According to the configuration in Japanese Patent Application Laid-Open No. 2000-77858, the second frame is mounted on the first frame with a pin provided at a stay of the first frame, fitted to a mounting hole provided at a stay of the second frame, resulting in positioning and coupling between the first frame and the second frame. Such coupling between the first frame and the second frame results in indirectly positioning between the struts of the first frame and the struts of the second frame.

For such coupling between the first frame and the second frame as in Japanese Patent Application Laid-Open No. 2000-77858, if the rigidity of a coupling portion is low, the coupling portion deforms due to impact applied at the time of conveyance of the image forming apparatus or the load of the apparatus itself, so that the relative positional accuracy between a first strut and a second strut is likely to deteriorate.

Deterioration in the relative positional accuracy between the first strut and the second strut causes deterioration in the relative positional accuracy between the first conveying roller and the second conveying roller, which is dependent on the positional accuracy between the first strut and the second strut. In this case, at the time of feed of a sheet from the first conveying roller to the second conveying roller, the sheet skews, causing a deviation in the image position to the sheet, so that the image forming quality is likely to deteriorate.

SUMMARY OF THE INVENTION

It is desirable to provide a frame of an image forming apparatus enabling enhancement of the rigidity of the coupling portion between a first strut of a first frame and a second strut of a second frame, the second strut being disposed at the upper portion in the vertical direction of the first strut.

According to a representative configuration of the present invention, provided is a frame of an image forming apparatus, including:

a first frame configured to support: a sheet cassette configured to house a sheet; and a first conveying roller configured to convey the sheet extracted from the sheet cassette;

a second frame disposed above the first frame in a vertical direction, the second frame being coupled to the first frame, the second frame being configured to support: a second conveying roller configured to receive the sheet conveyed by the first conveying roller and convey the sheet; and an image forming unit configured to form an image on the sheet conveyed by the second conveying roller; and a first strut configured to be part of the first frame, the first strut including: a first base portion; a first plate portion extending substantially perpendicularly from the first base portion; and a second plate portion extending substantially perpendicularly from the first base portion, the second plate portion being opposed to the first plate portion;

a second strut configured to be part of the second frame, the second strut including: a second base portion disposed above the first base portion in the vertical direction, the second base portion being in contact with the first base portion; a third plate portion extending substantially perpendicularly from the second base portion, the third plate portion being disposed above the first plate portion in the vertical direction; and a fourth plate portion extending substantially perpendicularly from the second base portion, the fourth plate portion being opposed to the third plate portion, the fourth plate portion being disposed above the second plate portion in the vertical direction, a coupling member coupling the first strut and the second strut, the coupling member including: a third base portion opposed to and spaced apart from the first base portion and the second base portion; a fifth plate portion extending substantially perpendicularly from the third base portion, the fifth plate portion being coupled to the first plate portion and the third plate portion; and a sixth plate portion extending substantially perpendicularly from the third base portion, the sixth plate portion being opposed to the fifth plate portion, the sixth plate portion being coupled to the second plate portion and the fourth plate portion.

Further features of the present invention will become apparent from the following description of exemplary embodiments with reference to the attached drawings.

DESCRIPTION OF THE EMBODIMENTS

First Embodiment

<Image Forming Apparatus>

The entire configuration of an image forming apparatus according to a first embodiment of the present invention will be described below together with the operation at the time of image forming with reference to the drawings. Note that, unless otherwise specified, the scope of the invention is not limited to the dimensions, materials, and shapes of the following constituent components and the relative arrangements thereof.

The image forming apparatus A according to the present embodiment is of an intermediate tandem type which transfers four-color toners of yellow Y, magenta M, cyan C, and black K to an intermediate transfer belt and then transfers an image to a sheet to form the image. Note that, in the following description, members which involve the yellow toner are denoted with Y as the suffix, members which involve the magenta toner are denoted with M as the suffix, members which involve the cyan toner are denoted with C as the suffix, and members which involve the black toner are denoted with K as the suffix. However, the configurations and operations of the members are substantially the same except for the colors of toner. Thus, the suffixes thereof will be appropriately omitted when no distinction is required.

Figure 1:
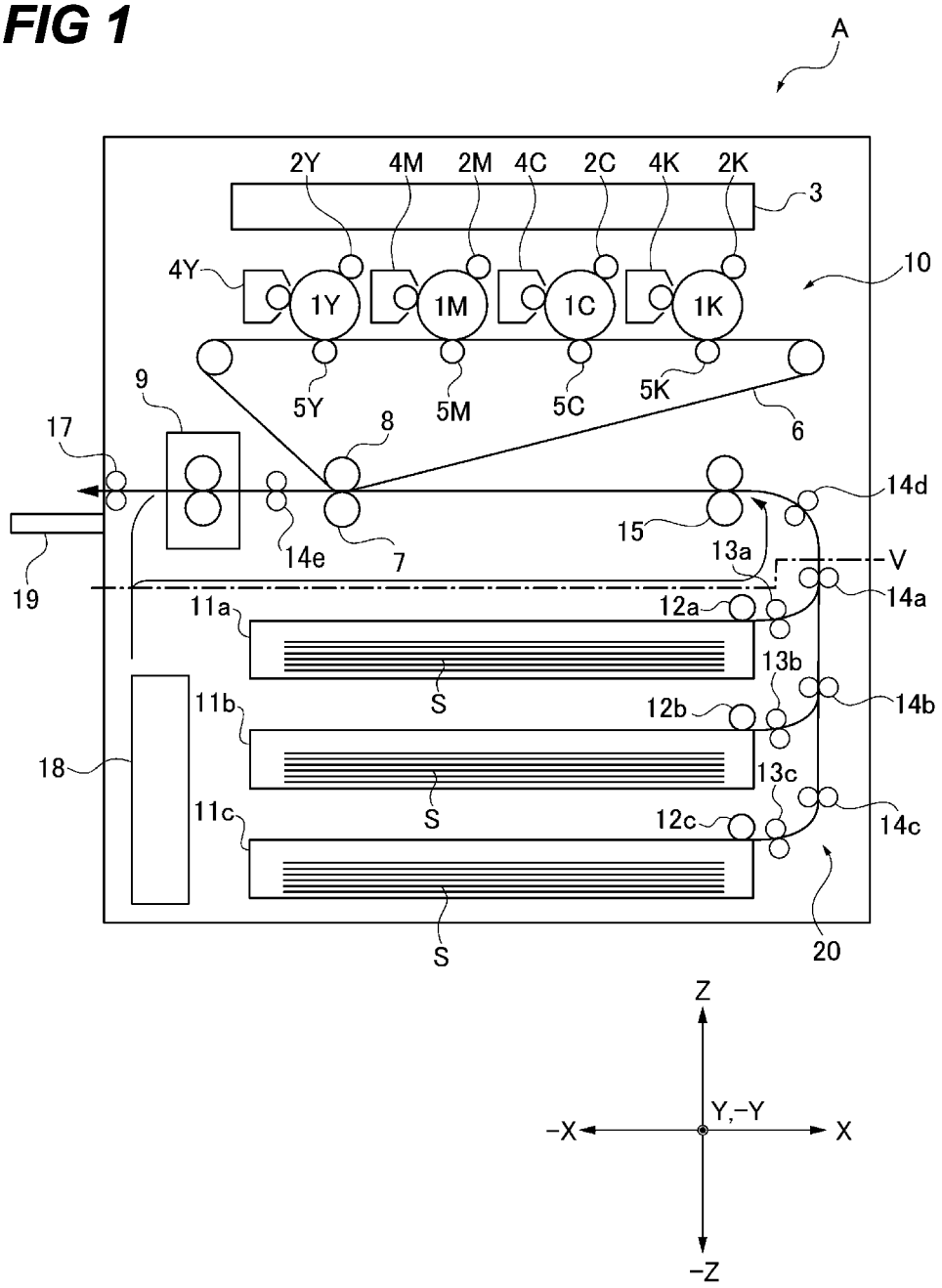
FIG. 1 is a schematic sectional view of an image forming apparatus.

FIG. 1 is a schematic sectional view of the image forming apparatus A. As illustrated in FIG. 1, the image forming apparatus A includes: an image forming unit 10 which forms an image on a sheet S; and a feed unit 20 which feeds the sheet S to the image forming unit 10.

The image forming unit 10 includes photoconductive drums 1 (1Y, 1M, 1C, and 1K) as photoconductors, charging rollers 2 (2Y, 2M, 2C, and 2K), and developing devices 4 (4Y, 4M, 4C, and 4K). The image forming unit 10 includes primary transfer rollers 5 (5Y, 5M, 5C, and 5K), a laser scanner unit 3, an intermediate transfer belt 6, a secondary transfer roller 7, and a secondary transfer counter roller 8.

The feed unit 20 includes: sheet cassettes 11*a* to 11*c* which each house sheets S; and pickup rollers 12*a* to 12*c* which each pick up a sheet S housed in the corresponding sheet cassette 11*a*, 11*b*, or 11*c*. The feed unit 20 includes: feed rollers 13*a* to 13*c* which each feed the sheet S picked up by the corresponding pickup roller 12*a*, 12*b*, or 12*c* to a conveyance path; conveying rollers 14*a* to 14*d* which each convey the sheet S on the conveyance path; and a registration roller 15.

At the time of formation of an image by the image forming apparatus A, first, an image forming job signal is input to a controller not illustrated. This arrangement causes a sheet S housed in any of the sheet cassettes 11*a* to 11*c* to be picked up by the corresponding pickup roller 12*a*, 12*b*, or 12*c*. Next, the sheet S is sent to the registration roller 15 by the corresponding feed roller 13*a*, 13*b*, or 13*c* and conveying roller 14*a*, 14*b*, 14*c*, or 14*d*. After that, the sheet S is subjected to correction of skew by the registration roller 15. Then, at a predetermined timing, the sheet S is sent to a secondary transfer portion formed by the secondary transfer roller 7 and the secondary transfer counter roller 8.

Meanwhile, in the image forming unit 10, first, the surface of the photoconductive drum 1Y is charged by the charging roller 2Y. After that, according to image data transmitted from external equipment not illustrated, the laser scanner unit 3 irradiates the surface of the photoconductive drum 1Y with laser light, to form an electrostatic latent image on the surface of the photoconductive drum 1Y. After that, the developing device 4Y causes the yellow tonner to adhere to the electrostatic latent image formed on the surface of the photoconductive drum 1Y, so that a yellow toner image is formed on the surface of the photoconductive drum 1Y. In response to application of a primary transfer bias to the primary transfer roller 5Y, the tonner image formed on the surface of the photoconductive drum 1Y is primary-transferred to the intermediate transfer belt 6.

In similar processes, a magenta toner image, a cyan toner image, and a black toner image are formed on the photoconductive drums 1M, 1C, and 1K, respectively. Then, in response to application of a primary transfer bias to each of the primary transfer rollers 5M, 5C, and 5K, the corresponding toner image is transferred so as to be superimposed on the yellow toner image on the intermediate transfer belt 6. This arrangement results in formation of a full-color toner image, corresponding to the image signal, on the surface of the intermediate transfer belt 6. Note that, after the primary transfer, the toners adhering to the photoconductive drums 1Y, 1M, 1C, and 1K are each removed by a cleaning member not illustrated, resulting in being collected in a toner collection container 18.

After that, the full-color toner image is sent to the secondary transfer portion by a circumferential run of the intermediate transfer belt 6. Then, in response to application of a secondary transfer bias to the secondary transfer roller 7, the full-color toner image on the intermediate transfer belt 6 is transferred to the sheet S at the secondary transfer portion. The sheet S to which the toner image is transferred is conveyed to a fixing device 9 by a conveying roller 14*e*. Then, the sheet S is subjected to heating and pressing by the fixing device 9, so that the toner image on the sheet S is fixed to the sheet S. After that, the sheet S to which the toner image is fixed is discharged to a discharge tray 19 by a discharge roller 17.

<Frame for Image Forming Apparatus>

Next, the configuration of a frame 100 for the image forming apparatus A will be described.

Figure 2:
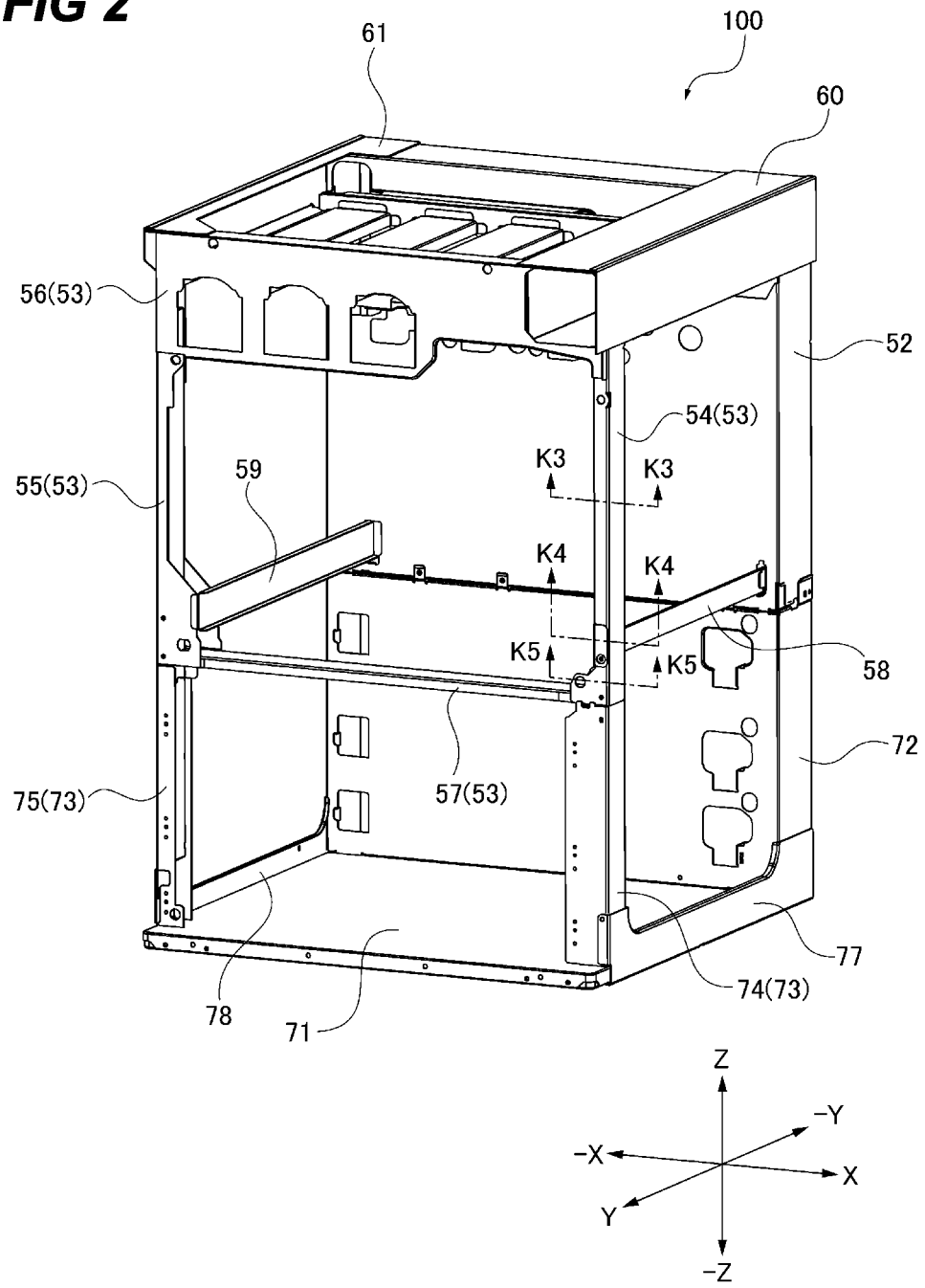
FIG. 2 is a perspective view of a frame of the image forming apparatus.
Figure 3:
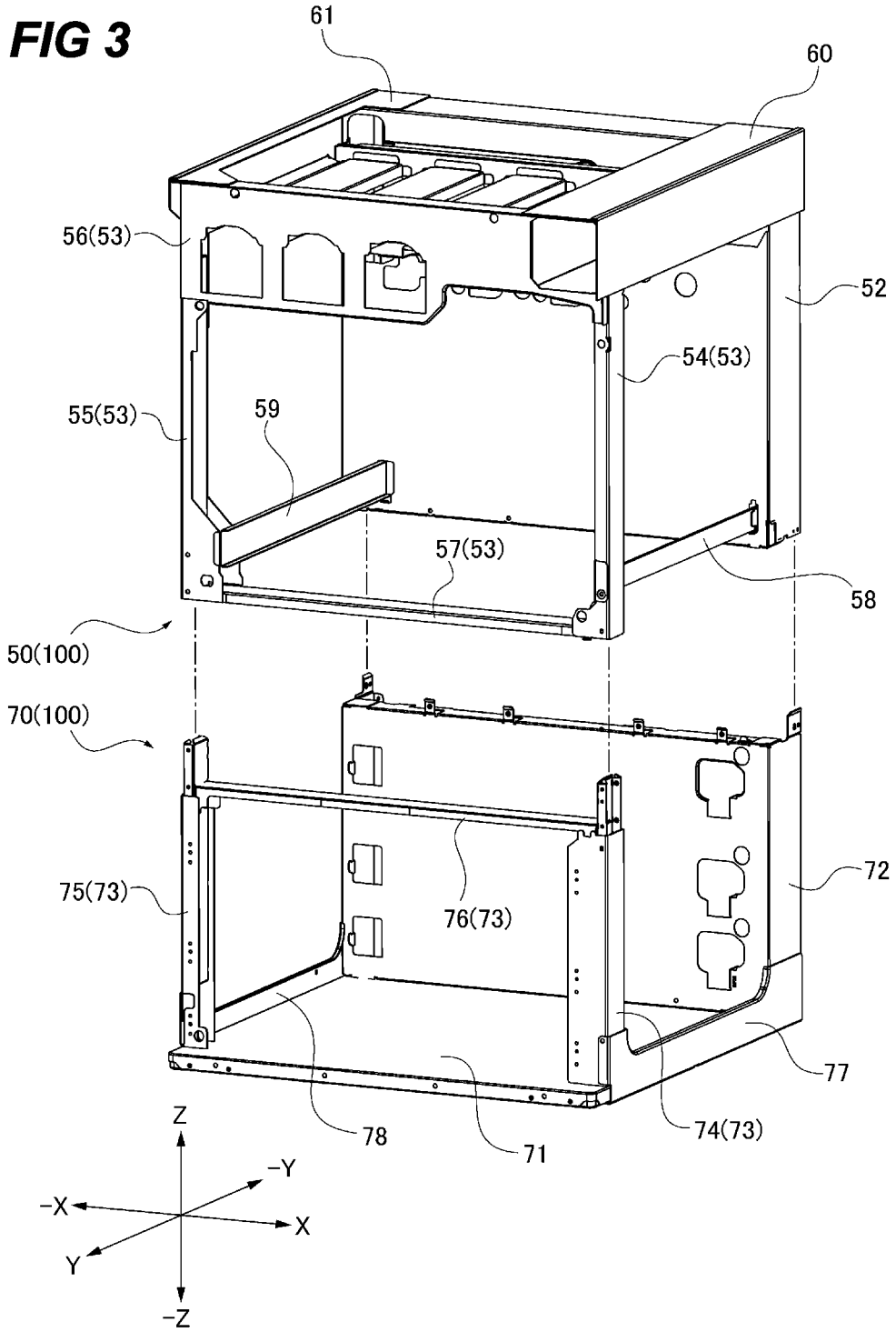
FIG. 3 is an exploded perspective view of the frame of the image forming apparatus.

FIG. 2 is a perspective view of the frame 100 for the image forming apparatus A. FIG. 3 is an exploded perspective view of the frame 100 for the image forming apparatus A. As illustrated in FIGS. 2 and 3, the frame 100 for the image forming apparatus A includes an upper frame 50 and a lower frame 70 coupled together. The upper frame 50 and the lower frame 70 are each made of sheet metal. The upper frame 50 is disposed at the upper portion in the vertical direction of the lower frame 70. Note that the lower frame 70 is to be, as the frame 100, incorporated normally with the image forming apparatus A and thus is different from a cassette pedestal unit which is optionally attached as an option for functional extension, such as an increase in the number of sheets S to be housed. A dot-and-dash line V illustrated in FIG. 1 indicates the boundary between the upper frame 50 and the lower frame 70.

The upper frame 50 (second frame) includes a front plate 53, a rear plate 52, and stays 58, 59, 60, and 61 which couple the front plate 53 and the rear plate 52 together. The front plate 53 includes an upper-right strut 54 (second strut), an upper-left strut 55, and stays 56 and 57 which couple the upper-right strut 54 and the upper-left strut 55 together. The stays 56 and 57 are welded to the upper-right strut 54 and the upper-left strut 55. The stay 58 is welded to the upper-right strut 54 and the rear plate 52. The stay 59 is welded to the upper-left strut 55 and the rear plate 52. The stays 60 and 61 are welded to the stay 56 and the rear plate 52.

The lower frame 70 (first frame) includes a front plate 73, a rear plate 72, stays 77 and 78 which couple the front plate 73 and the rear plate 72 together, and a bottom plate 71. The front plate 73 includes a lower-right strut 74 (first strut), a lower-left strut 75, and a stay 76 which couples the lower-right strut 74 and the lower-left strut 75 together. The stay 76 is welded to the lower-right strut 74 and the lower-left strut 75. The stay 77 is welded to the lower-right strut 74 and the rear plate 72. The stay 78 is welded to the lower-left strut 75 and the rear plate 72.

Figure 4:
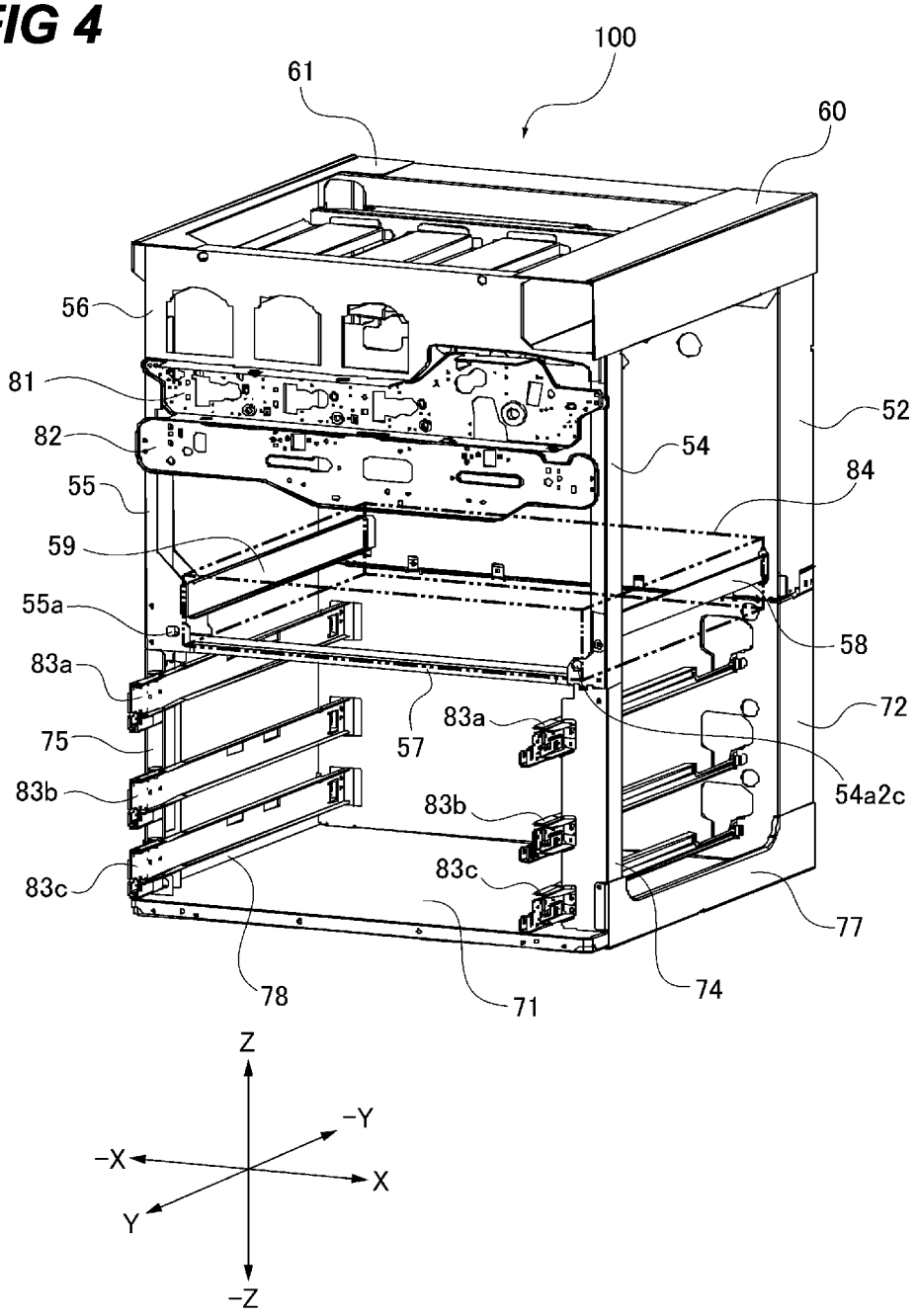
FIG. 4 is a perspective view of the frame of the image forming apparatus.

FIG. 4 illustrates the frame 100 for the image forming apparatus A, to which members which support the photoconductive drums 1 and the sheet cassettes 11 are attached. As illustrated in FIG. 4, a support member 81 which supports the photoconductive drums 1 and the developing devices 4, is positioned and attached to the upper-right strut 54 and the upper-left strut 55 of the upper frame 50. The support member 81 supports, rotatably, one end portion in the direction of the rotational axis of each of the photoconductive drums 1 and developing sleeves, not illustrated, included in the developing devices 4. The other end portion in the direction of the rotational axis of each of the photoconductive drums 1 and the developing sleeves is supported rotatably by the rear plate 52.

A belt support member 82 which supports the intermediate transfer belt 6 is positioned and attached to the upper-right strut 54 and the upper-left strut 55 of the upper frame 50. The belt support member 82 supports, rotatably, one end portion in the direction of the rotational axis of each of the secondary transfer counter roller 8 and the other rollers around which the intermediate transfer belt 6 is stretched. The other end portion in the direction of the rotational axis of the secondary transfer counter roller 8 is supported rotatably by the rear plate 52.

A front plate as the frame on the front side of a fixing and conveying unit 84 including the fixing device 9 and the conveying roller 14*e* united together, is attached to the upper-right strut 54 and the upper-left strut 55 of the upper frame 50. The position of the fixing and conveying unit 84 to the upper-right strut 54 and the upper-left strut 55 is determined by one-to-one fitting of pins, not illustrated, on the front plate of the fixing and conveying unit 84 to a fitting hole 54*a*2*c* formed on the upper-right strut 54 and a fitting hole 55*a* formed on the upper-left strut 55.

The conveying roller 14*d* (second conveying roller) is supported by the frame of the fixing and conveying unit 84. That is, determination of the position of the fixing and conveying unit 84 to the upper-right strut 54 and the upper-left strut 55 causes determination of the position of the conveying roller 14*d*. One end portion in the direction of the rotational axis of the conveying roller 14*a* (first conveying roller) which feeds a sheet S to the conveying roller 14*d*, is positioned to and then is supported rotatably by the lower-right strut 74. The other end portion in the direction of the rotational axis of the conveying roller 14*a* is supported rotatably by the rear plate 52.

A support rail 83*a* which supports the sheet cassette 11*a*, a support rail 83*b* which supports the sheet cassette 11*b*, and a support rail 83*c* which supports the sheet cassette 11*c* are positioned and attached to each of the lower-right strut 74 and the lower-left strut 75 of the lower frame 70. The support rails 83*a*, 83*b*, and 83*c* serve as stays (first coupling stay and second coupling stay) which couple the lower-right strut 74, the lower-left strut 75, and the rear plate 72 together. At the position between the lower-right strut 74 and the lower-left strut 75, the sheet cassettes 11*a* to 11*c* slide-move while being guided by the support rails 83*a* to 83*c* so as to be inserted in the direction of arrow −Y or so as to be drawn in the direction of arrow Y.

In the present embodiment, the front face of the image forming apparatus A is oriented in the direction of arrow Y in which the sheet cassettes 11*a* to 11*c* are drawable, and the rear face of the image forming apparatus A is oriented in the direction of arrow −Y in which the sheet cassettes 11*a* to 11*c* are insertable. The right face of the image forming apparatus A is oriented in the direction of arrow X orthogonal to the directions of arrows Y and −Y and the directions of arrows Z and −Z along the vertical direction. The left face of the image forming apparatus A is oriented in the direction of arrow −X inverse to the direction of arrow X. That is, in the direction of movement of the sheet cassettes 11*a* to 11*c*, the lower-right strut 74 and the lower-left strut 75 are disposed opposed to the rear plate 72 in the lower frame 70. The lower-right strut 74 and the lower-left strut 75 are disposed opposed to each other in the direction orthogonal to the direction of movement of the sheet cassettes 11*a* to 11*c* and the vertical direction.

<Struts>

Next, the configuration of the struts of the frame 100 for the image forming apparatus A will be described in detail. Note that the upper-right strut 54 and the lower-right strut 74 will be described below and are similar in configuration to the upper-left strut 55 (fourth strut) and the lower-left strut 75 (third strut), respectively.

Figure 5A:
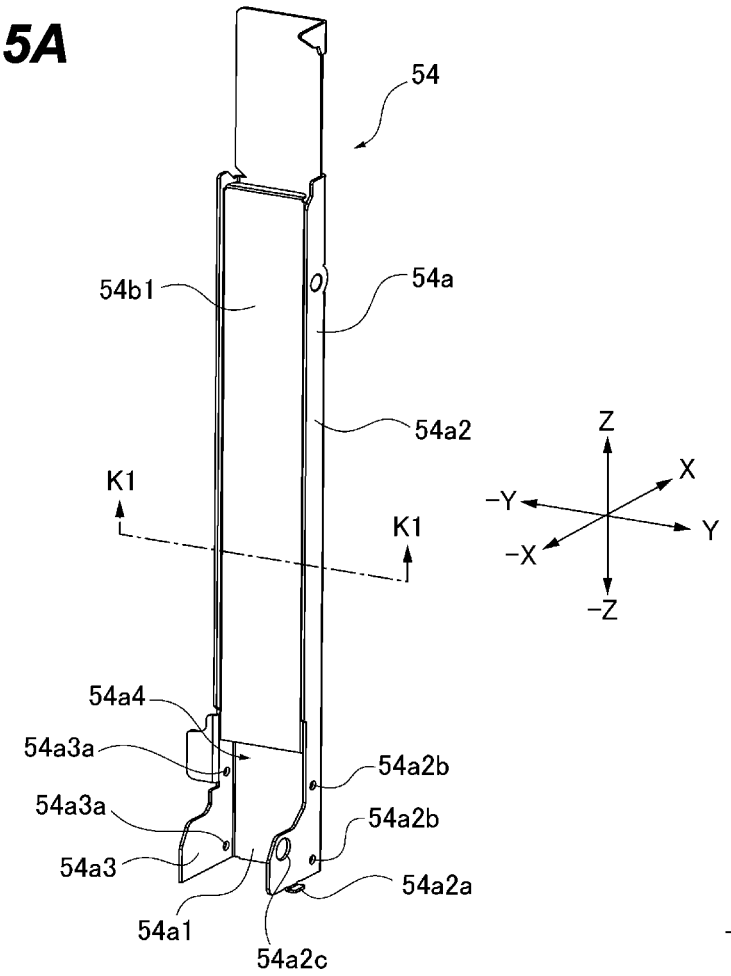
FIG. 5A is a perspective view of an upper-right strut.
Figure 5B:
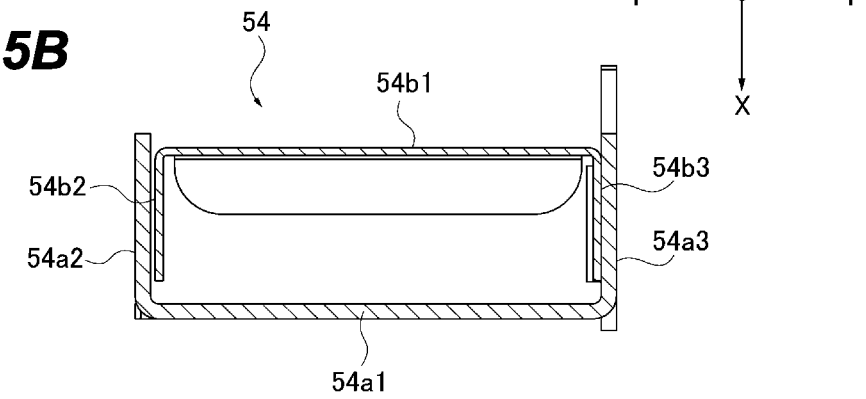
FIG. 5B is a sectional view of the upper-right strut.

FIG. 5A is a perspective view of the upper-right strut 54. FIG. 5B is a sectional view of the upper-right strut 54 taken along line K1-K1 of FIG. 5A. As illustrated in FIGS. 5A and 5B, the upper-right strut 54 includes an outer member 54*a* and an inner member 54*b* which are coupled through a screw not illustrated. Note that provided may be a configuration in which the outer member 54*a* and the inner member 54*b* are coupled by welding, a configuration in which the outer member 54*a* and the inner member 54*b* are integrally molded by casting or stamping, or a configuration in which the outer member 54*a* and the inner member 54*b* are integrally formed by cutting.

The outer member 54*a* includes: a base portion 54*a*1 (second base portion); a bent portion 54*a*2 (third plate portion) which is a substantially perpendicularly bent one end portion of the base portion 54*a*1; and a bent portion 54*a*3 (fourth plate portion) which is the substantially perpendicularly bent other end portion of the base portion 54*a*1 and is opposed to the bent portion 54*a*2. Thus, the outer member 54*a* has a U shape as a whole. Note that, in the present embodiment, the U shape of the outer member 54*a* results from one piece of sheet metal subjected to bending. However, a substantially U shape may be formed by combining two pieces of sheet metal, each having an L shape. The meaning "substantially perpendicular" herein includes not only an angle of 90 degrees of the bent portions 54*a*2 and 54*a*3 to the base portion 54*a*1 but also, for example, angles of 89 to 91 degrees in consideration of dimensional tolerance and manufacturing errors. The bent portions 54*a*2 and 54*a*3 may each have a step as long as the bent portions 54*a*2 and 54*a*3 are opposed to each other, substantially perpendicularly to the base portion 54*a*1. The bent portions 54*a*2 and 54*a*3 may each have a shape like an arc to the base portion 54*a*1.

The inner member 54*b* includes: a base portion 54*b*1 (fourth base portion); a bent portion 54*b*2 (seventh plate portion) which is a substantially perpendicularly bent one end portion of the base portion 54*b*1; and a bent portion 54*b*3 (eighth plate portion) which is the substantially perpendicularly bent other end portion of the base portion 54*b*1 and is opposed to the bent portion 54*b*2. The inner member 54*b* has a U shape as a whole. Note that, in the present embodiment, the U shape of the inner member 54*b* results from one piece of sheet metal subjected to bending. However, a substantially U shape may be formed by combining two pieces of sheet metal, each having an L shape. The meaning "substantially perpendicular" herein includes not only an angle of 90 degrees of the bent portions 54*b*2 and 54*b*3 to the base portion 54*b*1 but also, for example, angles of 89 to 91 degrees in consideration of dimensional tolerance and manufacturing errors. The bent portions 54*b*2 and 54*b*3 may each have a step as long as the bent portions 54*b*2 and 54*b*3 are opposed to each other, substantially perpendicularly to the base portion 54*b*1. The bent portions 54*b*2 and 54*b*3 may each have a shape like an arc to the base portion 54*b*1.

The outer member 54*a* and the inner member 54*b* are disposed such that their U-shaped opening portions face each other. That is the base portion 54*b*1 of the inner member 54*b* is spaced apart from and opposed to the base portion 54*a*1 of the outer member 54*a*. The bent portion 54*b*2 of the inner member 54*b* is coupled to the bent portion 54*a*2 of the outer member 54*a* through a screw not illustrated. The bent portion 54*b*3 of the inner member 54*b* is coupled to the bent portion 54*a*3 of the outer member 54*a* through a screw not illustrated. This arrangement secures the rigidity of the upper-right strut 54 having a rectangular sectional shape. That is, the inner member 54*b* is part of the upper-right strut 54 and serves as a reinforcing member which reinforces the outer member 54*a*.

The bent portion 54*a*2 of the outer member 54*a* has screw holes 54*a*2*b*, and the bent portion 54*a*3 of the outer member 54*a* has screw holes 54*a*3*a*. The lower end portion of the bent portion 54*a*2 of the outer member 54*a* is provided with a protrusion 54*a*2*a* (engaging portion) protruding in the direction of arrow Y. With the lower end portion of the outer member 54*a* located below the lower end portion of the inner member 54*b*, provided is a reception portion 54*a*4 which has a space due to a portion of the outer member 54*a* protruding below the inner member 54*b* and receives the lower-right strut 74.

Figure 6A:
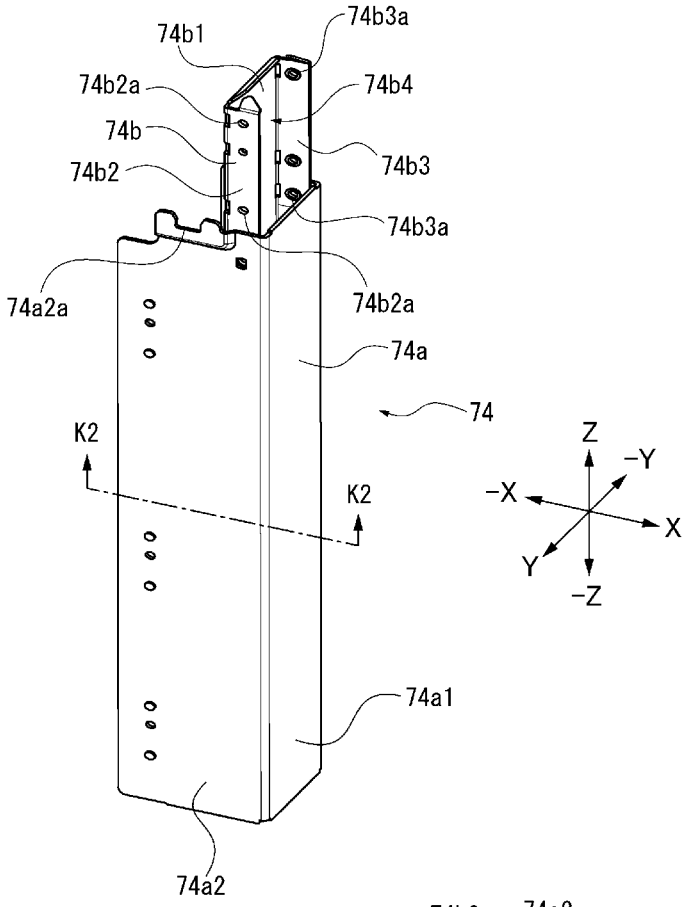
FIG. 6A is a perspective view of a lower-right strut.
Figure 6B:
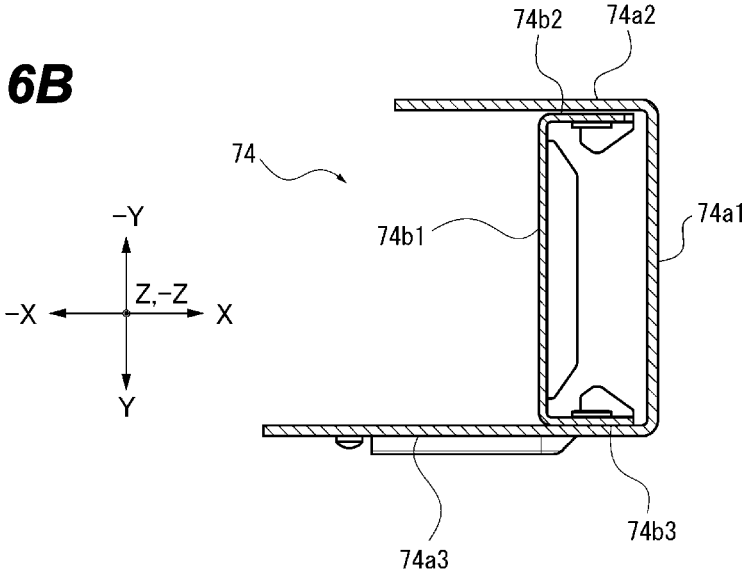
FIG. 6B is a sectional view of the lower-right strut.

FIG. 6A is a perspective view of the lower-right strut 74. FIG. 6B is a sectional view of the lower-right strut 74 taken along line K2-K2 of FIG. 6A. As illustrated in FIGS. 6A and 6B, the lower-right strut 74 includes an outer member 74*a* and an inner member 74*b* which are coupled through a screw not illustrated. Note that provided may be a configuration in which the outer member 74*a* and the inner member 74*b* are coupled by welding, a configuration in which the outer member 74*a* and the inner member 74*b* are integrally molded by casting or stamping, or a configuration in which the outer member 74*a* and the inner member 74*b* are integrally formed by cutting.

The outer member 74*a* includes: a base portion 74*a*1 (first base portion), a bent portion 74*a*2 (first plate portion) which is a substantially perpendicularly bent one end portion of the base portion 74*a*1; and a bent portion 74*a*3 (second plate portion) which is the substantially perpendicularly bent other end portion of the base portion 74*a*1 and is opposed to the bent portion 74*a*2. The outer member 74*a* has a U shape as a whole. Note that, in the present embodiment, the U shape of the outer member 74*a* results from one piece of sheet metal subjected to bending. However, a substantially U shape may be formed by combining two pieces of sheet metal, each having an L shape. The meaning "substantially perpendicular" herein includes not only an angle of 90 degrees of the bent portions 74*a*2 and 74*a*3 to the base portion 74*a*1 but also, for example, angles of 89 to 91 degrees in consideration of dimensional tolerance and manufacturing errors. The bent portions 74*a*2 and 74*a*3 may each have a step as long as the bent portions 74*a*2 and 74*a*3 are opposed to each other, substantially perpendicularly to the base portion 74*a*1. The bent portions 74*a*2 and 74*a*3 may each have a shape like an arc to the base portion 74*a*1.

The inner member 74*b* includes: a base portion 74*b*1 (third base portion); a bent portion 74*b*2 (fifth plate portion) which is a substantially perpendicularly bent one end portion of the base portion 74*b*1; and a bent portion 74*b*3 (sixth plate portion) which is the substantially perpendicularly bent other end portion of the base portion 74*b*1 and is opposed to the bent portion 74*b*2. The inner member 74*b* has a U shape as a whole. Note that, in the present embodiment, the U shape of the inner member 74*b* results from one piece of sheet metal subjected to bending. However, a substantially U shape may be formed by combining two pieces of sheet metal, each having an L shape. The meaning "substantially perpendicular" herein includes not only an angle of 90 degrees of the bent portions 74*b*2 and 74*b*3 to the base portion 74*b*1 but also, for example, angles of 89 to 91 degrees in consideration of dimensional tolerance and manufacturing errors. The bent portions 74*b*2 and 74*b*3 may each have a step as long as the bent portions 74*b*2 and 74*b*3 are opposed to each other, substantially perpendicularly to the base portion 74*b*1. The bent portions 74*b*2 and 74*b*3 may each have a shape like an arc to the base portion 74*b*1.

The outer member 74*a* and the inner member 74*b* are disposed such that their U-shaped opening portions face each other. That is the base portion 74*b*1 of the inner member 74*b* is spaced apart from and opposed to the base portion 74*a*1 of the outer member 74*a*. The bent portion 74*b*2 of the inner member 74*b* is coupled to the bent portion 74*a*2 of the outer member 74*a* through a screw not illustrated. The bent portion 74*b*3 of the inner member 74*b* is coupled to the bent portion 74*a*3 of the outer member 74*a* through a screw not illustrated. This arrangement secures the rigidity of the lower-right strut 74 having a rectangular sectional shape. That is, the inner member 74*b* is part of the lower-right strut 74 and serves as a reinforcing member which reinforces the lower-right strut 74.

The bent portion 74*b*2 of the inner member 74*b* has screw holes 74*b*2*a*, and the bent portion 74*b*3 of the inner member 74*b* has screw holes 74*b*3*a*. The upper end portion of the bent portion 74*a*2 of the outer member 74*a* is provided with a recessed portion 74*a*2*a* (engaged portion) which is recessed downward in the vertical direction. With the upper end portion of the inner member 74*b* located above the upper end portion of the outer member 74*a*, a portion of the inner member 74*b* protruding above the outer member 74*a* serves as a protruding portion 74*b*4 which is received by the reception portion 54*a*4 of the upper-right strut 54.

Figure 7A:
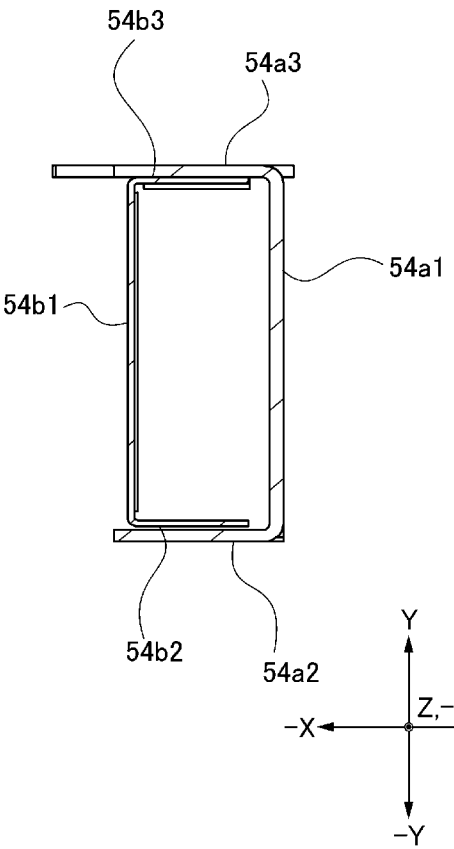
FIG. 7A is a sectional view taken along line K3-K3 of the frame of the image forming apparatus.
Figure 7B:
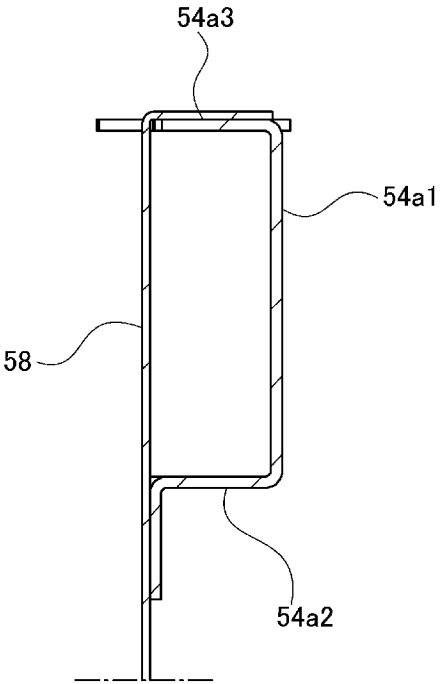
FIG. 7B is a sectional view taken along line K4-K4 of the frame of the image forming apparatus.
Figure 7C:
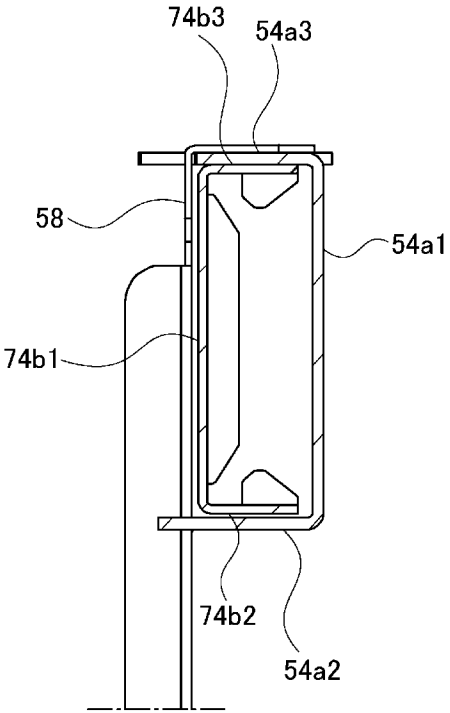
FIG. 7C is a sectional view taken along line K5-K5 of the frame of the image forming apparatus.

FIG. 7A is a sectional view of the frame 100 for the image forming apparatus A, taken along line K3-K3 of FIG. 2. FIG. 7B is a sectional view of the frame 100 for the image forming apparatus A, taken along line K4-K4 of FIG. 2. FIG. 7C is a sectional view of the frame 100 for the image forming apparatus A, taken along line K5-K5 of FIG. 2.

As illustrated in FIG. 7A, the sectional shape at the position of line K3-K3 of FIG. 2 is rectangular due to the outer member 54*a* and the inner member 54*b* of the upper-right strut 54. Specifically, the base portion 54*a*1, the bent portion 54*a*2, and the bent portion 54*a*3 of the outer member 54*a*, and the base portion 54*b*1 of the inner member 54*b* serve as the sides of the rectangular section. Note that the bent portion 54*a*2 of the outer member 54*a* and the bent portion 54*b*2 of the inner member 54*b* are disposed overlapping each other, and the bent portion 54*a*3 of the outer member 54*a* and the bent portion 54*b*3 of the inner member 54*b* are disposed overlapping each other.

As illustrated in FIG. 7B, the sectional shape at the position of line K4-K4 of FIG. 2 is rectangular due to the outer member 54*a* of the upper-right strut 54 and the stay 58. Specifically, the base portion 54*a*1, the bent portion 54*a*2, and the bent portion 54*a*3 of the outer member 54*a*, and the stay 58 serve as the sides of the rectangular section. That is, the stay 58 is coupled to the upper-right strut 54 such that a rectangular section is formed by the stay 58 together with the base portion 54*a*1, the bent portion 54*a*2, and the bent portion 54*a*3 of the outer member 54*a* between the inner member 54*b* of the upper-right strut 54 and the inner member 74*b* of the lower-right strut 74 in the vertical direction.

As illustrated in FIG. 7C, the sectional shape at the position of line K5-K5 of FIG. 2 is rectangular due to the outer member 54*a* of the upper-right strut 54 and the inner member 74*b* of the lower-right strut 74. Specifically, the base portion 54*a*1, the bent portion 54*a*2, and the bent portion 54*a*3 of the outer member 54*a* in the upper-right strut 54, and the base portion 74*b*1 of the inner member 74*b* in the lower-right strut 74 serve as the sides of the rectangular section. Note that the bent portion 54*a*2 of the outer member 54*a* in the upper-right strut 54 and the bent portion 74*b*2 of the inner member 74*b* in the lower-right strut 74 are disposed overlapping each other, and the bent portion 54*a*3 of the outer member 54*a* in the upper-right strut 54 and the bent portion 74*b*3 of the inner member 74*b* in the lower-right strut 74 are disposed overlapping each other.

As above, most of the upper-right strut 54 and the lower-right strut 74, which are the struts on the right side of the frame 100 for the image forming apparatus A, are rectangular in sectional shape regardless of position, resulting in enhancement in rigidity. Similarly, most of the upper-left strut 55 and the lower-left strut 75, which are the struts on the left side of the frame 100 for the image forming apparatus A, are rectangular in sectional shape regardless of position, resulting in enhancement in rigidity. Note that the coupling portion between the upper-right strut 54 and the lower-right strut 74 is located at the position of line K5-K5 of FIG. 2. As described above, the sectional shape of the coupling portion between the upper-right strut 54 and the lower-right strut 74 is rectangular, resulting in enhancement in the rigidity of the coupling portion between each strut. Note that, in the present embodiment, the sectional shape of each strut is rectangular. However, any quadrilateral, such as a square, enables enhancement in rigidity, and thus the sectional shape may be square.

<Configuration of Coupling of Struts>

As described above, the image forming unit 10, the sheet cassettes 11*a* to 11*c*, and the conveying rollers 14*a* and 14*d* are directly or indirectly positioned by the upper-right strut 54, the lower-right strut 74, the upper-left strut 55, and the lower-left strut 75. Thus, at the time of coupling of the upper frame 50 and the lower frame 70, a low relative positional accuracy between the upper-right strut 54 and the lower-right strut 74 or a low relative positional accuracy between the upper-left strut 55 and the lower-left strut 75 causes deterioration in the relative positional accuracy between the conveying roller 14*a* and the conveying roller 14*d*. In this case, at the time of feed of a sheet S from the conveying roller 14*a* to the conveying roller 14*d*, the sheet S skews, causing a deviation in the image position to the sheet S, so that the image forming quality is likely to deteriorate. Note that the registration roller 15 performs correction of skew to the sheet S, but some levels of skew of the sheet S are likely to disable correction of skew. Thus, in the present embodiment, the following configuration inhibits the relative positional accuracy between each strut from deteriorating.

Figure 8A:
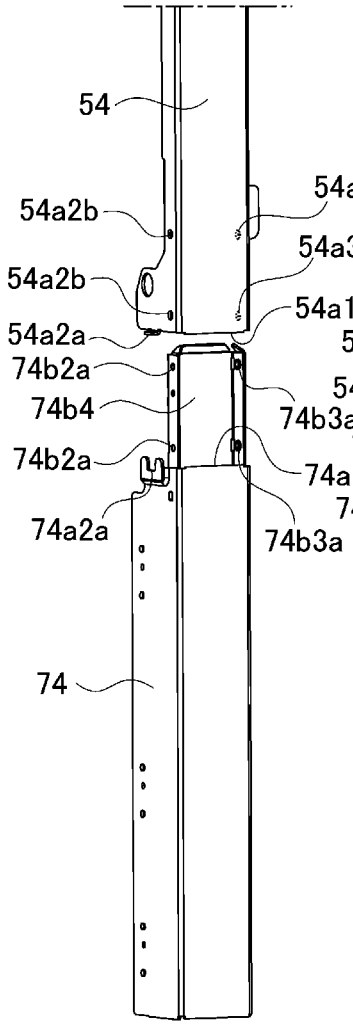
FIG. 8A is a perspective view of the upper-right strut and the lower-right strut before coupling.
Figure 8B:
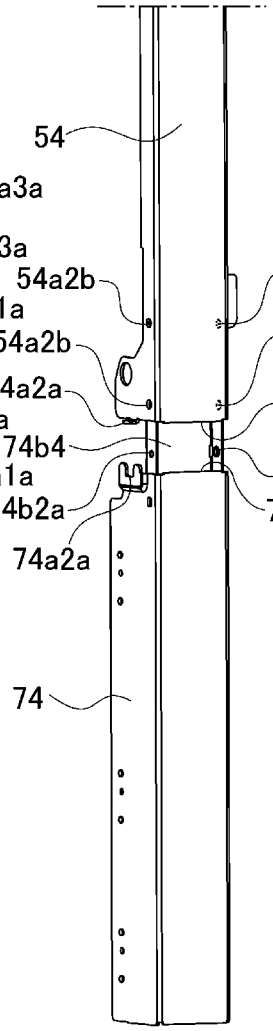
FIG. 8B is a perspective view of the upper-right strut and the lower-right strut, which are being coupled together.
Figure 8C:
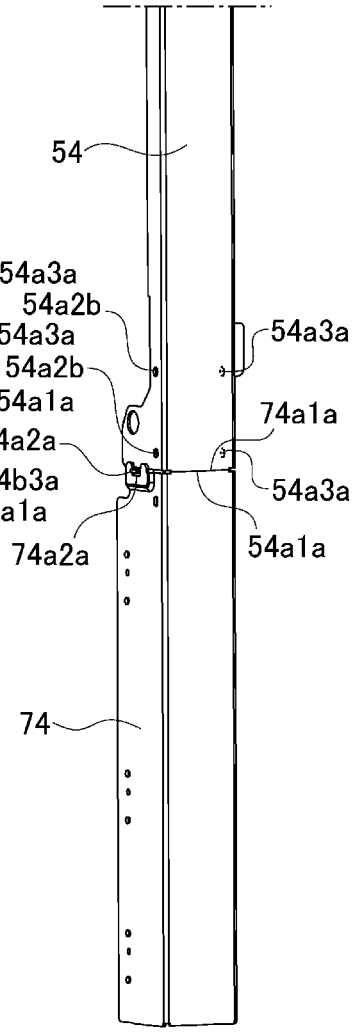
FIG. 8C is a perspective view of the upper-right strut and the lower-right strut coupled together.
Figure 8C:
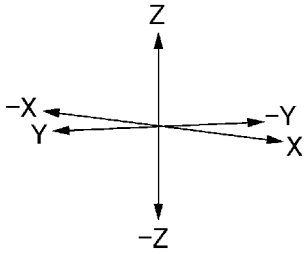
Figure 9A:
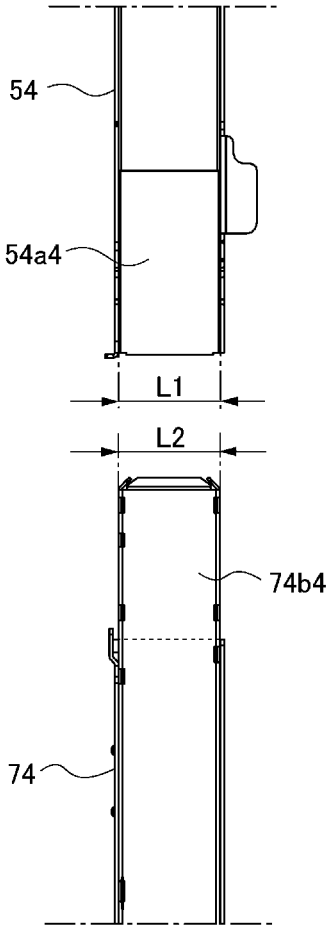
FIG. 9A is a plan view of the upper-right strut and the lower-right strut before coupling.
Figure 9B:
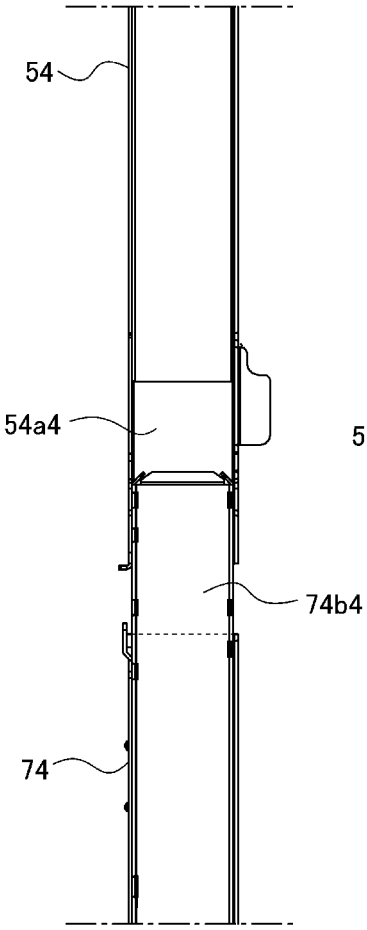
FIG. 9B is a plan view of the upper-right strut and the lower-right strut, which are being coupled together.
Figure 9C:
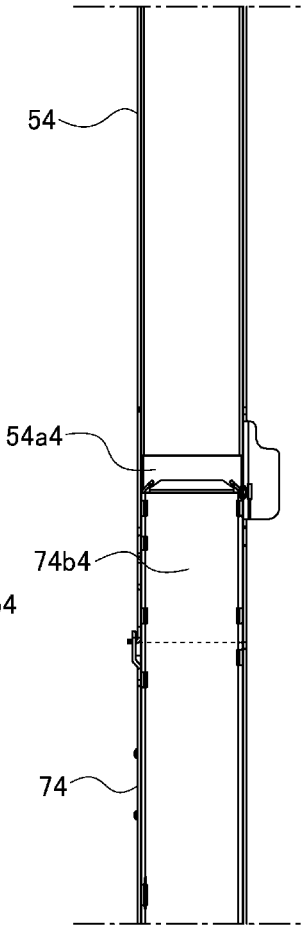
FIG. 9C is a plan view of the upper-right strut and the lower-right strut coupled together.
Figure 9C:
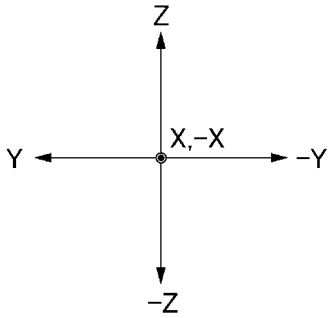

FIGS. 8A, 8B, and 8C are each a perspective view of the upper-right strut 54 and the lower-right strut 74. A process of coupling of the upper-right strut 54 and the lower-right strut 74 is illustrated in the order of FIGS. 8A, 8B, and 8C. FIGS. 9A, 9B, and 9C each illustrate the upper-right strut 54 and the lower-right strut 74 viewed in the direction of arrow −X. A process of coupling of the upper-right strut 54 and the lower-right strut 74 is illustrated in the order of FIGS. 9A, 9B, and 9C.

As illustrated in FIGS. 8A, 8B, 9A, and 9B, at the time of coupling of the upper-right strut 54 and the lower-right strut 74, first, a worker moves the upper-right strut 54 downward in the vertical direction, to insert the protruding portion 74*b*4 of the lower-right strut 74 into the reception portion 54*a*4 of the upper-right strut 54. At this time, with the bent portions 54*a*2 and 54*a*3 of the upper-right strut 54 in contact with the bent portions 74*b*2 and 74*b*3 of the lower-right strut 74, the upper-right strut 54 is guided to move in the vertical direction. The interval L1 between the inner face of the bent portion 54*a*2 and the inner face of the bent portion 54*a*3 of the upper-right strut 54 is wider by 0.5 mm than the interval L2 between the outer face of the bent portion 74*b*2 and the outer face of the bent portion 74*b*3 of the lower-right strut 74. Therefore, when the protruding portion 74b4 of the lower-right strut 74 is inserted into the reception portion 54a4 of the upper-right strut 54, the position in the direction of arrow Y of the upper-right strut 54 to the lower-right strut 74 is determined with a play of 0.5 mm.

Next, as illustrated in FIGS. 8C and 9C, the worker further moves the upper-right strut 54 downward in the vertical direction. Thus, a butt portion 54a1a which is the lower end portion of the base portion 54a1 of the upper-right strut 54 butts on a butt portion 74a1a which is the upper end portion of the base portion 74a1 of the lower-right strut 74, so that the position in the vertical direction of the upper-right strut 54 to the lower-right strut 74 is determined. The protrusion 54a2a at the bent portion 54a2 of the upper-right strut 54 fits to (engages with) the recessed portion 74a2a at the bent portion 74a2 of the lower-right strut 74. Thus, the position in the direction of arrow X of the upper-right strut 54 to the lower-right strut 74, namely, the movement in the direction orthogonal (crossing) to the vertical direction is regulated, so that the position in the direction orthogonal (crossing) to the vertical direction is determined.

As a result of such positioning between the upper-right strut 54 and the lower-right strut 74, the base portion 74a1 of the outer member 74a of the lower-right strut 74 is disposed adjacently to the base portion 54a1 of the outer member 54a of the upper-right strut 54 in the vertical direction. The upper end portion of the base portion 74a1 of the outer member 74a has contact with the lower end portion of the base portion 54a1 of the outer member 54a. The bent portion 74a2 of the outer member 74a of the lower-right strut 74 is disposed adjacently to the bent portion 54a2 of the outer member 54a of the upper-right strut 54 in the vertical direction. The bent portion 74a3 of the outer member 74a of the lower-right strut 74 is disposed adjacently to the bent portion 54a3 of the outer member 54a of the upper-right strut 54 in the vertical direction.

Next, the worker inserts screws, not illustrated, into the screw holes 54a2b at the bent portion 54a2 of the outer member 54a of the upper-right strut 54 and the screw holes 74b2a at the bent portion 74b2 of the inner member 74b of the lower-right strut 74, resulting in fastening. The worker inserts screws, not illustrated, into the screw holes 54a3a at the bent portion 54a3 of the outer member 54a of the upper-right strut 54 and the screw holes 74b3a at the bent portion 74b3 of the inner member 74b of the lower-right strut 74, resulting in fastening. Thus, the upper-right strut 54 and the lower-right strut 74 are coupled together. Thus, the position in the direction of arrow Y of the upper-right strut 54 to the lower-right strut 74, namely, the position in the direction orthogonal (crossing) to the vertical direction is determined. As described above, due to the fitting between the protrusion 54a2a of the upper-right strut 54 and the recessed portion 74a2a of the lower-right strut 74 and the screw fastening between the upper-right strut 54 and the lower-right strut 74, the upper-right strut 54 and the lower-right strut 74 are secured with determination in omnidirectional position in the direction orthogonal to the vertical direction. That is, in the present embodiment, the inner member 74b of the lower-right strut 74 is part of the lower-right strut 74 and serves as a coupling member which couples the upper-right strut 54 and the lower-right strut 74. Note that the inner member 74b of the lower-right strut 74 and the outer member 54a of the upper-right strut 54 may be coupled by welding.

As above, in the present embodiment, positioning between the upper-right strut 54 and the lower-right strut 74 is performed directly by both struts. Therefore, in comparison to a configuration in which positioning between the upper-right strut 54 and the lower-right strut 74 is performed indirectly by members attached to the upper-right strut 54 and the lower-right strut 74, the influence of tolerance is lower, so that the relative positional accuracy between the upper-right strut 54 and the lower-right strut 74 can be inhibited from deteriorating. Thus, at the time of feed of a sheet S from the conveying roller 14a to the conveying roller 14d, the sheet S is inhibited from skewing, so that the image position to the sheet S can be inhibited from deviating.

Second Embodiment

Next, a frame of the image forming apparatus A, according to a second embodiment of the present invention, will be described with the drawings. Parts the same as those according to the first embodiment are denoted with the same reference signs, and thus the descriptions thereof will be omitted.

Figures 10A, 10B, 10C:
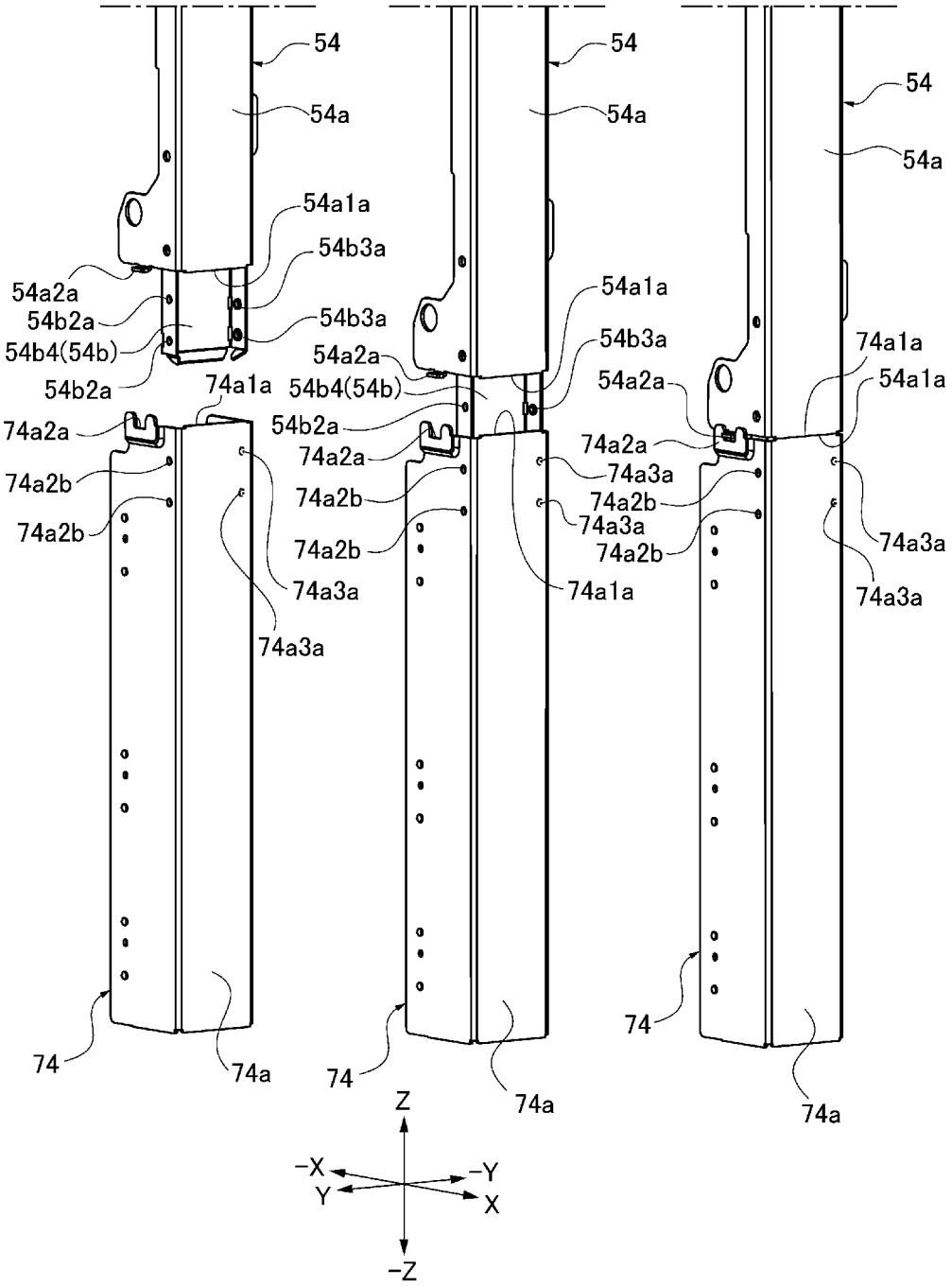
FIG. 10A is a perspective view of an upper-right strut and a lower-right strut according to a second embodiment before coupling.
FIG. 10B is a perspective view of the upper-right strut and the lower-right strut according to the second embodiment, which are being coupled together.
FIG. 10C is a perspective view of the upper-right strut and the lower-right strut according to the second embodiment, coupled together.
Figure 11A:
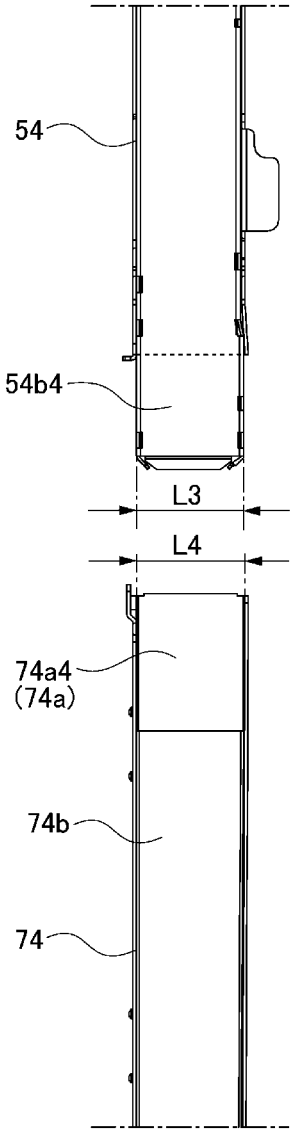
FIG. 11A is a plan view of the upper-right strut and the lower-right strut according to the second embodiment before coupling.
Figure 11B:
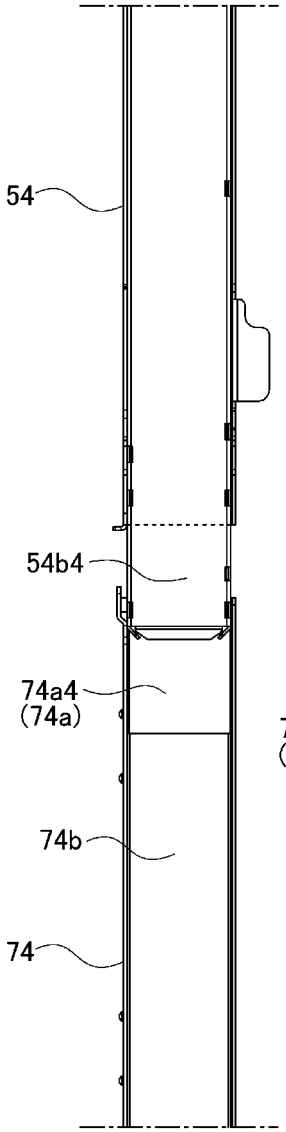
FIG. 11B is a plan view of the upper-right strut and the lower-right strut according to the second embodiment, which are being coupled together.
Figure 11C:
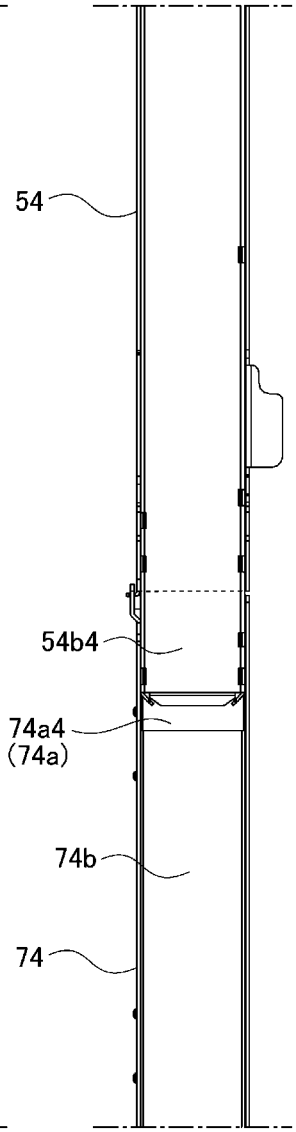
FIG. 11C is a plan view of the upper-right strut and the lower-right strut according to the second embodiment, coupled together.
Figure 11C:
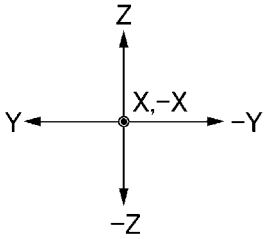

FIGS. 10A, 10B, and 10C are each a perspective view of an upper-right strut 54 and a lower-right strut 74 according to the present embodiment. A process of coupling of the upper-right strut 54 and the lower-right strut 74 is illustrated in the order of FIGS. 10A, 10B, and 10C. FIGS. 11A, 11B, and 11C each illustrate the upper-right strut 54 and the lower-right strut 74 according to the present embodiment, viewed in the direction of arrow −X. A process of coupling of the upper-right strut 54 and the lower-right strut 74 is illustrated in the order of FIGS. 11A, 11B, and 11C.

As illustrated in FIGS. 10A and 11A, in the present embodiment, the upper end portion of an outer member 74a is located above the upper end portion of an inner member 74b in the lower-right strut 74. Provided is a reception portion 74a4 which has a space due to a portion of the outer member 74a protruding above the inner member 74b and receives the upper-right strut 54. With the lower end portion of an inner member 54b located below the lower end portion of an outer member 54a in the upper-right strut 54, a portion of the inner member 54b protruding below the outer member 54a serves as a protruding portion 54b4 which is received by the reception portion 74a4 of the lower-right strut 74. That is, contrary to the first embodiment, in the present embodiment, the lower-right strut 74 has the reception portion 74a4 and the upper-right strut 54 has the protruding portion 54b4. The other configurations are similar to those according to the first embodiment.

As illustrated in FIGS. 10B and 11B, at the time of coupling of the upper-right strut 54 and the lower-right strut 74, first, a worker moves the upper-right strut 54 downward in the vertical direction, to insert the protruding portion 54b4 of the upper-right strut 54 into the reception portion 74a4 of the lower-right strut 74. At this time, with bent portions 54b2 and 54b3 of the upper-right strut 54 in contact with bent portions 74a2 and 74a3 of the lower-right strut 74, the upper-right strut 54 is guided to move in the vertical direction. The interval L3 between the outer face of the bent portion 54b2 and the outer face of the bent portion 54b3 of the upper-right strut 54 is narrower by 0.5 mm than the interval L4 between the inner face of the bent portion 74a2 and the inner face of the bent portion 74a3 of the lower-right strut 74. Therefore, when the protruding portion 54b4 of the upper-right strut 54 is inserted into the reception portion 74a4 of the lower-right strut 74, the position in the direction of arrow Y of the upper-right strut 54 to the lower-right strut 74 is determined with a play of 0.5 mm.

Next, as illustrated in FIGS. 10C and 11C, the worker further moves the upper-right strut 54 downward in the vertical direction. Thus, a butt portion 54*a*1*a* which is the lower end portion of a base portion 54*a*1 of the upper-right strut 54 butts on a butt portion 74*a*1*a* which is the upper end portion of a base portion 74*a*1 of the lower-right strut 74, so that the position in the vertical direction of the upper-right strut 54 to the lower-right strut 74 is determined. A protrusion 54*a*2*a* at a bent portion 54*a*2 of the upper-right strut 54 fits to a recessed portion 74*a*2*a* at the bent portion 74*a*2 of the lower-right strut 74. Thus, the position in the direction of arrow X of the upper-right strut 54 to the lower-right strut 74 is determined.

As a result of such positioning between the upper-right strut 54 and the lower-right strut 74, the base portion 74*a*1 of the outer member 74*a* of the lower-right strut 74 is disposed adjacently to the base portion 54*a*1 of the outer member 54*a* of the upper-right strut 54 in the vertical direction. The upper end portion of the base portion 74*a*1 of the outer member 74*a* has contact with the lower end portion of the base portion 54*a*1 of the outer member 54*a*. The bent portion 74*a*2 of the outer member 74*a* of the lower-right strut 74 is disposed adjacently to the bent portion 54*a*2 of the outer member 54*a* of the upper-right strut 54 in the vertical direction. The bent portion 74*a*3 of the outer member 74*a* of the lower-right strut 74 is disposed adjacently to a bent portion 54*a*3 of the outer member 54*a* of the upper-right strut 54 in the vertical direction.

Next, the worker inserts screws, not illustrated, into screw holes 54*b*2*a* at the bent portion 54*b*2 of the inner member 54*b* of the upper-right strut 54 and screw holes 74*a*2*b* at the bent portion 74*a*2 of the outer member 74*a* of the lower-right strut 74, resulting in fastening. The worker inserts screws, not illustrated, into screw holes 54*b*3*a* at the bent portion 54*b*3 of the inner member 54*b* of the upper-right strut 54 and screw holes 74*a*3*a* at the bent portion 74*a*3 of the outer member 74*a* of the lower-right strut 74, resulting in fastening. Thus, the upper-right strut 54 and the lower-right strut 74 are coupled together. That is, in the present embodiment, the inner member 54*b* of the upper-right strut 54 is part of the upper-right strut 54 and serves as a coupling member which couples the upper-right strut 54 and the lower-right strut 74. Note that the inner member 54*b* of the upper-right strut 54 and the outer member 74*a* of the lower-right strut 74 may be coupled by welding.

As above, in the present embodiment, positioning between the upper-right strut 54 and the lower-right strut 74 is performed directly by both struts. Therefore, in comparison to a configuration in which positioning is performed by members attached to the upper-right strut 54 and the lower-right strut 74, the influence of tolerance is lower, so that the relative positional accuracy between the upper-right strut 54 and the lower-right strut 74 can be inhibited from deteriorating. Thus, at the time of feed of a sheet S from the conveying roller 14*a* to the conveying roller 14*d*, the sheet S is inhibited from skewing, so that the image position to the sheet S can be inhibited from deviating.

Note that, in the present embodiment, given has been the configuration in which the image forming unit 10, the sheet cassettes 11*a* to 11*c*, and the conveying rollers 14*a* and 14*d* are positioned by the front plate 53 of the upper frame 50 and the front plate 73 of the lower frame 70. However, the present invention is not limited to this. That is the members may be positioned by the rear plate 52 of the upper frame 50 and the rear plate 72 of the lower frame 70. In this case, coupling between a strut of the rear plate 52 of the upper frame 50 and a strut of the rear plate 72 of the lower frame 70 is performed similarly to coupling between the upper-right strut 54 and the lower-right strut 74, so that a similar effect can be acquired.

Figure 12:
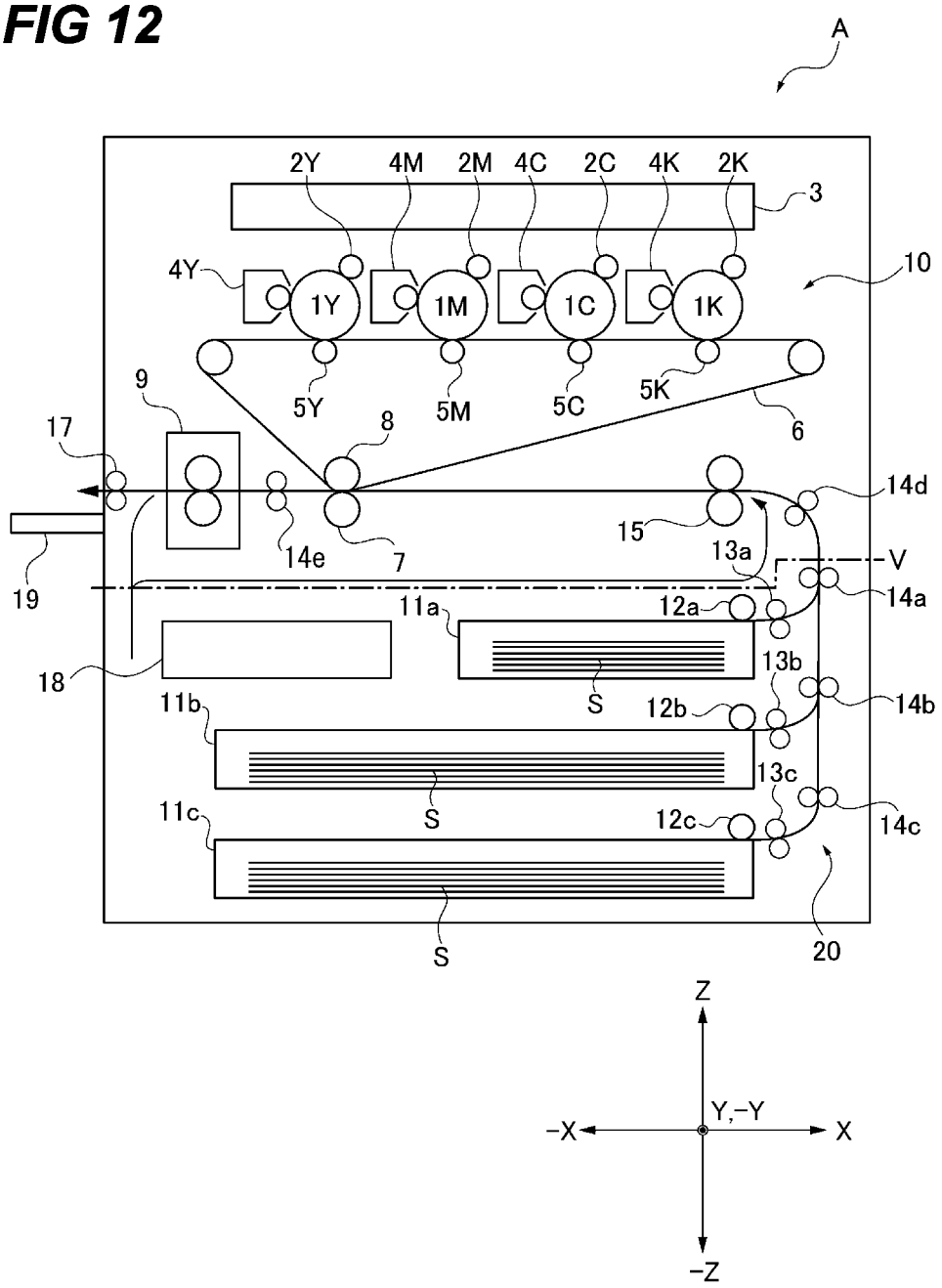
FIG. 12 is a schematic sectional view of an image forming apparatus according to another embodiment.

The arrangement of each member supported by the upper frame 50 or the lower frame 70 can be changed appropriately. For example, as illustrated in FIG. 12, the sheet cassette 11*a*, which is supported by the lower frame 70, may be miniaturized to house small-sized sheets S. In addition, the toner collection container 18 may be disposed at a space resulting from the miniaturization.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-086346, filed May 15, 2020 which is hereby incorporated by reference herein in its entirety.

What is claimed is:

1. An image forming apparatus, comprising:

a sheet cassette configured to accommodate a sheet;

an image forming unit configured to form an image on the sheet fed from the sheet cassette;

a first conveying roller configured to convey the sheet extracted from the sheet cassette;

a second conveying roller configured to receive the sheet conveyed by the first conveying roller and convey the sheet;

a first frame configured to support the sheet cassette and the first conveying roller;

a second frame disposed above the first frame in a vertical direction, the second frame being coupled to the first frame, the second frame configured to support the second conveying roller and the image forming unit;

a first strut configured to be part of the first frame, the first strut including: a first base portion; a first plate portion extending substantially perpendicularly from the first base portion; and a second plate portion extending substantially perpendicularly from the first base portion, the second plate portion being opposed to the first plate portion, wherein the first base portion, the first plate portion and the second plate portion are formed integrally by a single metal plate, a second strut configured to be part of the second frame, the second strut including: a second base portion disposed above the first base portion in the vertical direction, the second base portion being in contact with the first base portion; a third plate portion extending substantially perpendicularly from the second base portion, the third plate portion being disposed above the first plate portion in the vertical direction; and a fourth plate portion extending substantially perpendicularly from the second base portion, the fourth plate portion being opposed to the third plate portion, the fourth plate portion being disposed above the second plate portion in the vertical direction, wherein the second base portion, the third plate portion and the fourth plate portion are formed integrally by a single metal plate, and a coupling member coupling the first strut and the second strut, the coupling member including: a third base portion opposed to and spaced apart from the first base portion and the second base portion; a fifth plate portion extending substantially perpendicularly from the third base portion, the fifth plate portion being coupled to the first plate portion and the third plate portion; and a sixth plate portion extending substantially perpendicularly from the third base portion, the sixth plate portion being opposed to the fifth plate portion, the sixth plate portion being coupled to the second plate portion and the fourth plate portion, wherein the third base portion, the fifth plate portion and the sixth plate portion are formed integrally by a single metal plate.

2. The image forming apparatus according to claim 1, wherein the first strut includes a reinforcing member which reinforces the first strut, the reinforcing member being disposed below the coupling member in the vertical direction, the reinforcing member including: a fourth base portion; a seventh plate portion extending substantially perpendicularly from the fourth base portion; and an eighth plate portion extending substantially perpendicularly from the fourth base portion, the eighth plate portion being opposed to the seventh plate portion, the fourth base portion of the reinforcing member is opposed to and spaced apart from the first base portion of the first strut, wherein the seventh plate portion of the reinforcing member is coupled to the first plate portion of the first strut, and the eighth plate portion of the reinforcing member is coupled to the second plate portion of the first strut, and wherein the fourth base portion, the seventh plate portion and the eighth plate portion are formed integrally by a single metal plate.

3. The image forming apparatus according to claim 1, wherein the second strut includes a reinforcing member which reinforces the second strut, the reinforcing member being disposed above the coupling member in the vertical direction, the reinforcing member including: a fourth base portion; a seventh plate portion extending substantially perpendicularly from the fourth base portion; and an eighth plate portion extending substantially perpendicularly from the fourth base portion, the eighth plate portion being opposed to the seventh plate portion, wherein the fourth base portion of the reinforcing member is opposed to and spaced apart from the second base portion of the second strut, and the seventh plate portion of the reinforcing member is coupled to the third plate portion of the second strut, and the eighth plate portion of the reinforcing member is coupled to the fourth plate portion of the second strut, and wherein the fourth base portion, the seventh plate portion and the eighth plate portion are formed integrally by a single metal plate.

4. The image forming apparatus according to claim 3, wherein the second frame includes: a side plate disposed opposed to the second strut in a direction of a rotational axis of the second conveying roller; and a stay coupled to the second strut and the side plate, wherein the stay is coupled to the second strut such that a rectangular section is formed by the stay together with the second base portion, the third plate portion, and the fourth plate portion of the second strut at least between the coupling member and the reinforcing member in the vertical direction.

5. The image forming apparatus according to claim 3, wherein the first frame includes: a third strut opposed to the first strut in a direction orthogonal to a rotational axis direction of the first conveying roller and the vertical direction; a first rear plate opposed to the first strut and the third strut in the direction of the rotational axis of the first conveying roller; and a bottom plate disposed at respective lower portions in the vertical direction of the first strut, the third strut, and the first rear plate such that the first strut, the third strut, and the first rear plate are fixed to the bottom plate, and the second frame includes: a fourth strut opposed to the second strut in a direction orthogonal to a rotational axis direction of the second conveying roller and the vertical direction, the fourth strut being coupled to the third strut; and a second rear plate opposed to the second strut and the fourth strut in the direction of the rotational axis of the second conveying roller, the second rear plate being coupled to the first rear plate.

6. The image forming apparatus according to claim 5, further comprising:

another coupling member coupling the third strut and the fourth strut, wherein the third strut includes: a fifth base portion; a ninth plate portion extending substantially perpendicularly from the fifth base portion; and a tenth plate portion extending substantially perpendicularly from the fifth base portion, the tenth plate portion being opposed to the ninth plate portion, wherein the fifth base portion, the ninth plate portion and the tenth plate portion are formed integrally by a single metal plate, the fourth strut includes: a sixth base portion disposed at an upper portion in the vertical direction of the fifth base portion, the sixth base portion being in contact with the fifth base portion; an eleventh plate portion extending substantially perpendicularly from the sixth base portion, the eleventh plate portion being disposed at an upper portion in the vertical direction of the ninth plate portion; and a twelfth plate portion extending substantially perpendicularly from the sixth base portion, the twelfth plate portion being opposed to the eleventh plate portion, the twelfth plate portion being disposed at an upper portion in the vertical direction of the tenth plate portion, wherein the sixth base portion, the eleventh plate portion and the twelfth plate portion are formed integrally by a single metal plate, and the another coupling member includes: a seventh base portion opposed to and spaced apart from the fifth base portion and the sixth base portion; a thirteenth plate portion extending substantially perpendicularly from the seventh base portion, the thirteenth plate portion being coupled to the ninth plate portion and the eleventh plate portion; and a fourteenth plate portion extending substantially perpendicularly from the seventh base portion, the fourteenth plate portion being opposed to thirteenth plate portion, the fourteenth plate portion being coupled to the tenth plate portion and the twelfth plate portion, wherein the seventh base portion, the thirteenth plate portion and the fourteenth plate portion are formed integrally by a single metal plate.

7. The image forming apparatus according to claim 5, further comprising:

a first coupling stay coupling the first strut and the first rear plate, and a second coupling stay coupling the third strut and the first rear plate, wherein the first coupling stay and the second coupling stay supporting the sheet cassette are slidable.

8. The image forming apparatus according to claim 5, further comprising:

a support member configured to support a photoconductor, together with the second rear plate, the support member being coupled to the second strut and the fourth strut.

9. The image forming apparatus according to claim 1, wherein the third plate portion of the second strut includes an engaging portion which engages with an engaged portion at the first plate portion of the first strut, and a movement of the second strut in a direction crossing the vertical direction relative to the first strut is regulated due to the engagement of the engaging portion with the engaged portion.

10. The image forming apparatus according to claim 9, wherein the engaged portion is a recessed portion which is recessed downward at part of an upper end portion of the first plate portion of the first strut, and the engaging portion is a protrusion at a lower end portion of the third plate portion of the second strut.

11. The image forming apparatus according to claim 1, wherein the coupling member is coupled, by a screw, to each of the first strut and the second strut.

12. The image forming apparatus according to claim 1, wherein the coupling member is coupled, by welding, to each of the first strut and the second strut.

13. The image forming apparatus according to claim 1, further comprising:

a registration roller configured to correct skew feeding of the sheet conveyed by the second conveying roller.

* * * * *